US005164070A

United States Patent [19]

Munro

[11] Patent Number: 5,164,070

[45] Date of Patent: Nov. 17, 1992

[54] HYDROCRACKING PRODUCT RECOVERY PROCESS

[75] Inventor: William H. Munro, Mancos, Colo.

[73] Assignee: UOP, Des Plaines, Ill.

[21] Appl. No.: 665,121

[22] Filed: Mar. 6, 1991

[51] Int. Cl.[5] ..... C10G 69/02; C10G 49/22; C10G 7/00; B01D 3/00

[52] U.S. Cl. ..... 208/60; 208/102; 208/104; 208/100; 208/208 R; 208/218; 208/354; 208/356

[58] Field of Search ..... 208/100, 102, 104, 354–356, 208/60, 208 R, 218

[56] References Cited

U.S. PATENT DOCUMENTS 3,472,758 10/1969 Stine et al. ..... 208/59
3,502,572 3/1970 Watkins et al. ..... 208/111
3,655,551 4/1972 Hass et al. ..... 208/59

OTHER PUBLICATIONS

N. Choudhary et al., "Hydrocracking: A Review", p. 74, *Industrial Engineering & Chemistry Prod. Res. Dev.*, vol. 14, Nov. 2, 1975.

*Primary Examiner*—Theodore Morris
*Assistant Examiner*—P. L. Hailey
*Attorney, Agent, or Firm*—Thomas K. McBride; John F. Spears, Jr.

[57] ABSTRACT

The recovery of distillate products from a hydrocracking process includes passing the liquid-phase portion of the reaction zone effluent into a stripping column. A naphtha sidecut stream is recovered off the stripping column and combined with the net overhead liquid of the column. These combined streams are then combined with the naphtha recovered from the primary product recovery column. This minimizes the hydrogen sulfide present in the total naphtha product.

15 Claims, 1 Drawing Sheet

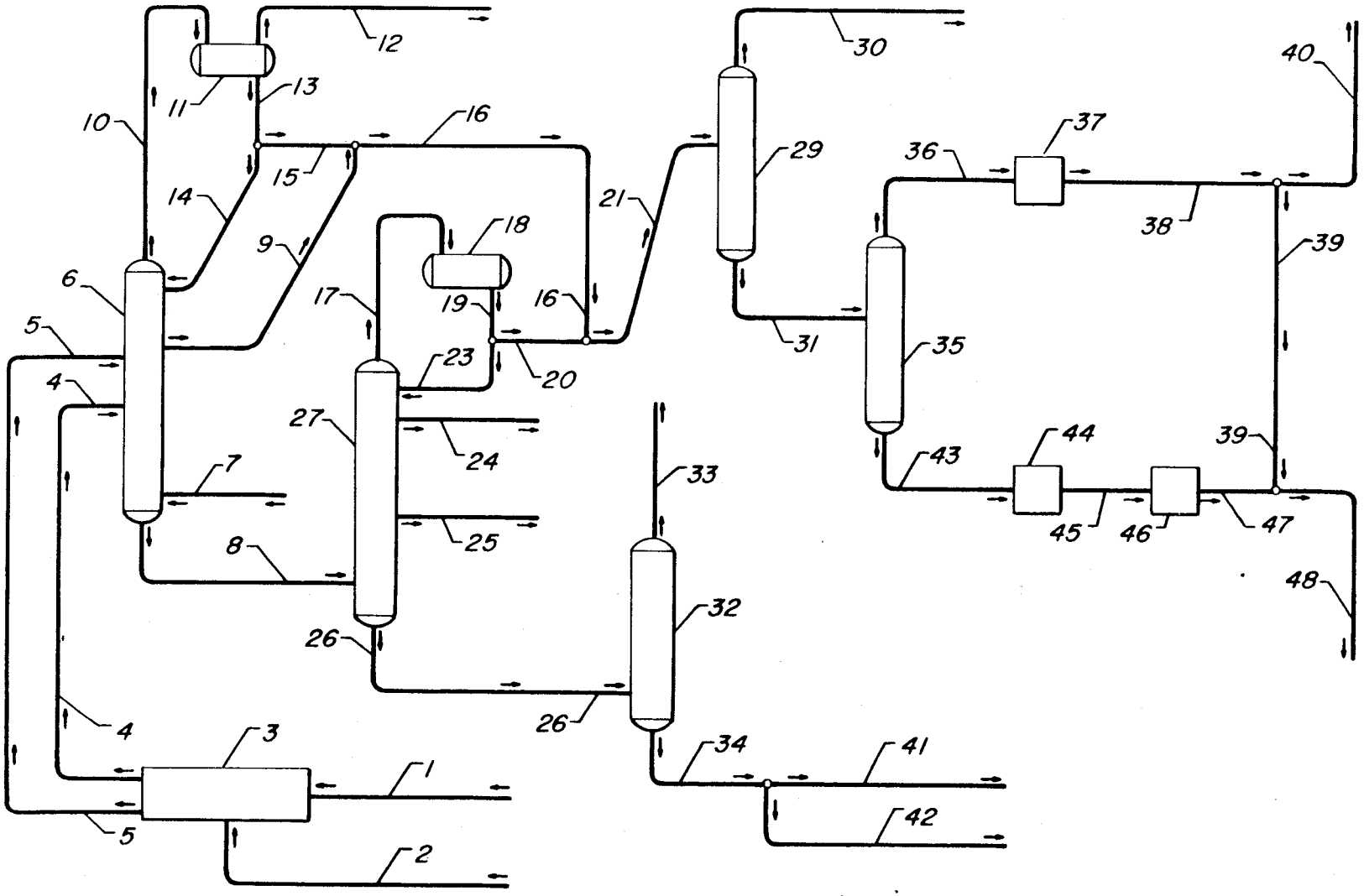
40
39
48
47
39
38
46
37
44
45
36
35
43
30
41
42
29
31
33
32
34
21
16
20
26
18
19
23
24
25
16
12
17
27
26
1
2
13
15
9
8
3
11
14
7
10
6
5
4
4
5

HYDROCRACKING PRODUCT RECOVERY PROCESS

FIELD OF THE INVENTION

The invention broadly relates to the widely employed hydrocarbon conversion process referred to as hydrocracking. This process is used for upgrading residual petroleum fractions into more valuable products. The invention specifically relates to the product recovery steps practiced in hydrocracking distillates, such as vacuum gas oils, to produce gasoline, kerosene and diesel fuel. The subject invention specifically relates to the minimization of hydrogen sulfide present within the naphtha boiling range fuel products recovered from a catalytic hydrocracking reaction zone.

PRIOR ART

Hydrocracking is a well developed process that is widely used in petroleum refineries for converting and upgrading distillate fractions. A review of hydrocracking catalysts, processing applications and flow schemes is provided in a paper by N. Choudhary et al. published at page 74 of *Industrial Engineering & Chemistry*, Prod. Res. Dev., Vol. 14, No. 2, 1975.

Numerous flow schemes have been developed to recover the products of a hydrocracking process. These flow schemes normally employ one or more fractionation columns in series. A representative example is believed presented in U.S. Pat. No. 3,472,758 issued to L. 0. Stine et al which shows a hydrocracking process flow wherein the liquid phase effluent of a hydrocracking reactor is passed into a stripping column. The bottoms stream of the stripping column is passed into a product fractionation column which produces a naphtha boiling range product stream.

U.S. Pat. No. 3,502,572 issued to C. H. Watkins et al is believed pertinent for its teaching of a similar flow wherein the reaction zone liquid product is passed into a stripping column located upstream of a primary fractionation column. When two or more reactors are employed in the reaction zone the product fractionation system will often employ an intermediate fractionation column which could function as a stripping column. U.S. Pat. No. 3,655,551 issued to R. H. Hass et al is believed pertinent for its general teaching as to a multireactor hydrocracking reaction zone and associated product recovery techniques.

BRIEF SUMMARY OF THE INVENTION

The invention is a hydrocracking process encompassing an integrated product fractionation zone which yields an untreated naphtha product having a reduced hydrogen sulfide content. The invention is characterized by the passage of the liquid-phase effluent(s) of a hydrocracking reaction zone into a first stripping column from which are withdrawn both net overhead liquid and sidecut streams comprising naphtha. Admixture of these two streams produces a naphtha having a lower hydrogen sulfide concentration than a normal net overhead stream. The stripping column bottoms stream is further fractionated in sequential product and vacuum columns, with additional naphtha being recovered from the stripping column bottoms stream.

One embodiment of the invention may be characterized as a hydrocracking process which comprises the steps of passing a liquid-phase stream comprising hydrocarbons recovered from the effluent of a hydrocracking reaction zone and hydrogen sulfide into a stripping column operated at conditions effective to separate the entering liquid phase stream into a first net overhead liquid stream comprising hydrogen sulfide and naphtha boiling range product hydrocarbons, a net overhead vapor stream comprising hydrogen sulfide and a first net bottoms stream comprising unconverted feed hydrocarbons and middle distillate boiling range product hydrocarbons; removing a first sidecut stream, which comprises naphtha boiling range product hydrocarbons, from the stripping column; and passing the first net bottoms stream into a middle distillate product recovery column operated at conditions effective to separate the entering hydrocarbons into a second net bottoms stream comprising unconverted hydrocarbons, a second sidecut stream, which comprises middle distillate hydrocarbons, and a second net overhead liquid stream, which comprises naphtha boiling range hydrocarbons.

BRIEF DESCRIPTION OF THE DRAWING

The Drawing is a diagram of the subject process wherein two liquid phase effluents of the hydrocracking reaction zone 3 are passed into a stripping column 6 which produces both a sidecut naphtha stream 9 and a net overhead naphtha stream 15. The naphtha is ultimately recovered via lines 21, 31, 40 and 48.

DETAILED DESCRIPTION

Processes are known for upgrading essentially any heavy feedstock into more valuable lighter distillate products such as gasoline, kerosene and jet fuel. However, significant challenges remain in developing economically competitive processes which lower the cost of the conversion. It is an objective of the subject invention to provide an improved hydrocracking process wherein residual feedstocks are converted to high value distillate products. Another objective of the subject invention is to reduce the content of hydrogen sulfide in the naphtha boiling range distillate product produced in a hydrocracking process.

The higher value of naphtha and middle distillates as compared to residual feedstocks provides an economic incentive for their conversion as by catalytic cracking, thermal cracking, or hydrocracking. The aromatic hydrocarbons present in the gasoline (naphtha) boiling range distillate fraction recovered from the hydrocracker are often valuable intermediates or feed materials. For instance, the benzene and xylenes in the naphtha may be recovered for use as feedstocks in petrochemical plants. These distillates have several quality specifications including boiling range and sulfur content. It is therefore desired to produce low sulfur content hydrocracking products to in turn reduce the need for downstream treating or fractionation to achieve these product specifications. Concentration of the hydrogen sulfide produced during hydrocracking also economizes its conversion or adsorption prior to disposal.

The manner in which the subject invention accomplishes these objectives is illustrated in the drawing. Referring now to the drawing, a feedstream enters a hydrocracking reaction zone through line 1. The feedstream will contain high molecular weight carbonaceous compounds and may comprise a vacuum gas oil or one of the other feed materials set out herein. The feedstream may contain recycled unconverted hydrocarbons, from line 41. The feedstream is combined with makeup hydrogen from line 2 and hydrogen-rich recycle gas not shown and the combination of these materials is heated to reaction conditions in a fired heater which is also not shown. The resultant charge stream is then passed into one or more hydrocracking reactors located, together with other customary equipment such as vapor-liquid separators and compressors, in the overall reaction zone of the hydrocracking process.

The hydrocracking reactor(s) preferably contains a fixed bed of hydrocracking catalyst which is maintained at hydrocracking conditions as set out herein. Contacting of the feedstream and hydrogen with the catalyst at these hydrocracking conditions results in the conversion of a significant portion of the feed hydrocarbons to lighter distillate hydrocarbons having lower boiling points in the range of naphtha, jet fuel and diesel fuel. Some lighter materials including ethane, propane, butane and pentanes are also produced. The effluent of the reactor is normally cooled to effect condensation of a significant portion of these distillate products which are present in vapor leaving the reactor. Normally some material also exits the reactor as liquid. There is thereby produced at least one and possibly two liquid phase hydrocracking reaction zone effluent streams carried via lines 4 and 5 into a stripping column 6 at different elevations. For instance, separate liquid streams may be recovered from a hot flash separator and from a high pressure separator located within the reaction zone 3.

The stripping column is operated at conditions of temperature and pressure which effect the separation of the entering hydrocarbon streams into a net overhead stream ultimately withdrawn in line 15, a naphtha sidecut stream withdrawn in line 9 and a net bottoms stream withdrawn in line 8. The liquid phase streams produced in the hydrocracking reaction zone will contain dissolved hydrogen sulfide produced in the reaction zone by the hydrogenation of sulfur-containing feed materials. As the hydrogen sulfide is more volatile than the majority of hydrocarbons present in the stripping column, it will readily pass upward through the stripping column 6 and the great majority of the hydrogen sulfide will be removed as part of the overhead vapor stream carried by line 10. The overhead vapor stream will pass through an overhead condenser not shown which effects the partial condensation of the overhead vapor stream and the formation of a liquid hydrocarbon phase which is collected in the overhead receiver 11. Light gases such as hydrogen originally dissolved in the reaction zone effluent stream, hydrogen sulfide, methane and ethane are vented from the overhead receiver through line 12. The condensed hydrocarbon phase is removed through line 13 and divided into a first portion returned to an upper portion of the stripping column 6 via line 14 as reflux and a second portion withdrawn through line 15 as the net overhead liquid stream of the stripping column. The hydrocarbon liquid removed from the receiver 11 will contain an amount of dissolved hydrogen sulfide set by the conditions in the receiver.

Steam is preferably charged to the bottom of the stripping column through line 7 to effect stripping of the lighter hydrocarbons and more volatile materials from the entering liquids. Alternatively, a reboiler may be placed at the bottom of the stripping column to effect or aid in achieving the desired degree of stripping. The stripping column is intended to remove a great majority of naphtha boiling hydrocarbons from the entering liquid streams and to also remove essentially all lower boiling hydrocarbons. In accordance with subject invention, the remaining heavier hydrocarbons are discharged through line 8 as the net bottoms stream of the stripping column. This net bottoms stream will include some dissolved naphtha boiling range hydrocarbons, but will predominate in middle distillate boiling range hydrocarbons such as diesel, jet fuel and kerosene boiling range hydrocarbons and unconverted hydrocarbons.

As used herein the term unconverted hydrocarbons is intended to indicate hydrocarbons having boiling points above that of the heaviest intended distillate product of the process. Unconverted hydrocarbons therefore comprise hydrocarbons which have passed through the hydrocarbon reaction zone with essentially no change in molecular weight and those which have undergone only a slight reduction in molecular weight and are hence still unsuitable for inclusion in a desired product. The latter could also be referred to as underconverted.

In accordance with the subject invention, a sidecut stream of naphtha is removed from the stripping column through line 9. This liquid phase stream is withdrawn directly from the column and preferably is then admixed with the net overhead stream of the column flowing through line 15. Due to the conditions maintained within the stripping column and the stripping action which occurs therein the hydrogen sulfide concentration in the sidecut stream will be lower than in the hydrocarbons removed from the overhead receiver in line 13. There is therefore achieved a reduction in the hydrogen sulfide content of the total naphtha withdrawn from the stripping column. This result may also be viewed as increasing the amount of hydrogen sulfide which is rejected from the stripping column.

The net bottoms stream of the stripping column is passed into a fractionation column 27 referred to herein as the middle distillate product recovery column. The middle distillate hydrocarbons produced in the overall process are primarily recovered from this column. These hydrocarbons include a product stream comprising kerosene boiling range hydrocarbons withdrawn through line 24 and a product stream comprising diesel boiling range hydrocarbons withdrawn through line 25. The remaining hydrocarbons which enter column 27 are separated into a second net overhead liquid stream removed through line 20 and a second net bottoms stream removed through line 26. The net bottoms stream of line 26 should include essentially all of the unconverted hydrocarbons originally present in the reaction zone effluent streams of lines 4 and 5. The lightest hydrocarbons which enter column 27 emerge as the overhead vapor stream carried by line 17. This overhead vapor stream is subjected to partial condensation in an overhead receiver not shown and the resultant mixed-phase stream is passed into the overhead receiver 18. Liquid phase hydrocarbons are removed in line 19 and divided into a first portion which is returned to the product recovery column via line 23 as reflux and the second net overhead stream of line 20. The second net overhead stream will contain the naphtha boiling range hydrocarbons not removed in the stripping column 6 and therefore remaining in the first net bottoms stream carried by line 8.

The naphtha boiling range hydrocarbons flowing through line 16 are combined with the net overhead stream of the middle distillate product recovery column 27 and passed via line 21 into a second stripping column 29. This column is designed and operated to function as a debutanizer column. Accordingly essentially all of the hydrocarbons having four or less carbon atoms per molecule which enter the column are rejected overhead as a net overhead stream of line 30. The remaining naphtha boiling range hydrocarbons exit column 29 as a third net bottoms stream carried by line 31 and enter the naphtha splitting column 35. The naphtha splitting column 35 is designed and operated to divide the entering hydrocarbons into two separate naphtha boiling range fractions. There are the light naphtha stream of line 36 and the heavy naphtha stream of line 43.

The light naphtha stream is passed through a treating zone 37 to remove residual hydrogen sulfide and reduce mercaptans to an acceptable level. This produces a treated light naphtha stream of line 38. The treated naphtha stream may be totally withdrawn from the process by line 40. The heavy naphtha stream of line 43 is passed through a second treating zone 44 to remove residual sulfur compounds such as hydrogen sulfide, mercaptans and carbonyl sulfide. It is then passed via line 45 into a catalytic reforming zone 46 wherein it is converted to a reformate removed in line 47. The reformate of line 47, together with any desired portion of the treated light naphtha passed through line 39, is withdrawn from the process via line 48. The naphtha streams of lines 40 and 48 may be employed as gasoline blending components or passed into aromatics extraction units for the recovery of benzene and xylene used in the production of petrochemicals. The light naphtha stream can also be subjected to further fractionation to yield a paraffin-rich fraction charged to an isomerization zone. This would be to increase the octane number of the paraffins prior to blending it into a gasoline.

The net bottoms stream withdrawn from column 27 is passed through line 26 into a vacuum column 32. This column is designed and operated to separate the entering hydrocarbons into the net overhead stream of line 33 comprising additional diesel boiling range hydrocarbons and the net bottoms stream of line 34 which comprises the unconverted hydrocarbons originally present in the hydrocracking zone effluent streams 4 and 5. This net bottoms stream may, if so desired be divided into a recycle stream of line 41 and a net drag stream of line 42. The net drag stream preferably comprises less than 5 volume percent of the fresh feed charged to the hydrocracking zone by line 1.

It is greatly preferred that a hot flash separator is employed within the reaction zone. This provides relatively high temperature liquid to the stripping column 6 via line 4. Feeding such a high temperature stream to the column reduces the required heat input to the column and greatly facilitates the subject process. Such a hot flash separation zone is characterized by a lack of upstream cooling by indirect heat exchange and by the charge stream to the zone being a liquid stream, which liquid may be withdrawn from a hot vapor-liquid separator. A significant pressure reduction is performed to generate a hot flash vapor stream.

Those skilled in the art will recognize that numerous pieces of process equipment and ancillary apparatus are not illustrated on the drawing. For instance, the drawing does not illustrate hydrogen purification or recovery or a hydrogen bleed line used to remove any accumulated light materials although such a stream may be employed. The drawing also does not illustrate the placement of compressors, flow control valves, flow control systems, fractionation column internal structures, the reboiler and overhead systems required on the fractionation zones 29, 32 and 35 and other equipment. Such equipment may be of customary nature.

The reaction zone effluent of a conventional hydrocracking process is typically removed from the vessel containing the catalyst bed, heat exchanged with the feed to the reaction zone and then passed into a vapor-liquid separation zone often referred to as a high pressure separator. Additional cooling can be done prior to this separation. In some instances a hot flash separator is used upstream of the high pressure separator. The vapor phase from the separator(s) is further cooled to recover additional hydrocarbons and if desired treated to remove hydrogen sulfide prior to use as recycle gas. The liquid phases recovered from the different separation vessels located within the reaction zone are customarily passed into a fractionation zone.

It is preferred that the effluent of the hydrocracking reactor located in the reaction zone is a mixed-phase stream. However, it is envisioned that the effluent stream of the reactor could be a vapor phase stream if high conversion hydrocracking conditions are maintained and/or a light feed stream is processed. In this instance it would be necessary to extract heat from the effluent stream and cause a desired degree of condensation as by indirect heat exchange upstream of the first stripping column. Admixture with a cool fluid would have a similar effect.

Those of ordinary skill in the art of petroleum process engineering are able to calculate with a high degree of accuracy the distribution of a mixture of hydrocarbons between liquid and vapor phases at any set temperature and pressure, the required operating conditions and dimensions of suitable fractionation columns. The operating conditions of the fractionation column employed in the subject process can be chosen based upon these calculations or reference materials to yield the desired separations.

The subject process is especially useful in the production of middle distillate fractions boiling in the range of about 300°-700° F. (149°-371° C.) as determined by the appropriate ASTM test procedure. The kerosene boiling range is intended to refer to about 300°-450° F. (149°-232° C.) and diesel boiling range is intended to refer to hydrocarbon boiling points of about 450°-about 700° F. (232°-371° C.). Gasoline or naphtha is normally the $C_5$ to about 400° F. (204° C.) endpoint fraction of available hydrocarbons. The boiling point ranges of the various product fractions will vary depending on specific market conditions, refinery location, etc. One common variation is the production of light and heavy naphtha fractions as shown on the drawing.

The hydrocracking reactions will reduce the average molecular weight of the feed stream hydrocarbons resulting in the production of gasoline and middle distillate (kerosene and diesel fuel) boiling range hydrocarbons and some lighter but valuable by-products such as LPG. In addition, other useful hydroprocessing reactions such as hydrodenitrification and hydrodesulfurization will occur simultaneously with hydrocracking of the feedstock. This leads to the production of hydrogen sulfide and ammonia and their presence in the hydrocracking zone effluent stream.

Typical feedstocks to the hydrocracking zone include virtually any heavy mineral oil and fractions thereof. Thus, such feedstocks as straight run gas oils, vacuum gas oils, demetallized oils, deasphalted vacuum residue, coker distillates, cat cracker distillates, shale oil, tar sand oil, coal liquids, and the like are contemplated. The preferred feedstock will have a boiling point range starting at a temperature above 160° Celsius but would not contain appreciable asphaltenes. It is preferred that less than about 25 volume percent of the hydrocarbons in the feed stream have boiling points below about 240 degrees C. Feedstocks with end boiling points under about 830° F. (443° C.) are preferred. Preferred feedstocks include gas oils having at least 50% volume of their components boiling above 700° F. (371° C.). The feedstock may contain nitrogen usually present as organonitrogen compounds in amounts between 1 ppm and 1.0 wt. %. The feed will normally contain sulfur-containing compounds sufficient to provide a sulfur content greater than 0.15 wt. %. It may also contain mono- and/or polynuclear aromatic compounds in amounts of 50 volume percent and higher.

Hydrocracking conditions employed in the subject process are those customarily employed in the art for hydrocracking equivalent feedstocks. Hydrocracking reaction temperatures are in the range of 400° to 1200° F. (204°-649° C.), preferably between 600° and 950° F. (316°-510° C.). Reaction pressures are in the range of atmospheric to about 3,500 psi (24,233 kPa), preferably the hydrogen partial pressure is between 1000 and 2000 psi (6,895-13,790 kPa). Contact times usually correspond to liquid hourly space velocities (LHSV) in the range of about 0.1 $hr^{-1}$ to 15 $hr^{-1}$, preferably between about 0.2 and 3 $hr^{-1}$. Hydrogen circulation rates are in the range of 1,000 to 50,000 standard cubic feet (scf) per barrel of charge (178-8,888 std. $m^3/m^3$), preferably between 5,000 and 30,000 scf per barrel of charge (887-5,333 std. $m^3/m^3$).

The subject process is not restricted to the use of a specific hydrocracking catalyst. Different types of hydrocracking catalysts can therefore be employed effectively in the subject process. For instance, the metallic hydrogenation components can be supported on a totally amorphous base or on a base comprising an admixture of amorphous and zeolitic materials. The nonzeolitic hydrocracking catalysts will typically comprise a support formed from silica-alumina and alumina. In some instances, a clay is used as a component of the nonzeolitic catalyst base.

Many hydrocracking catalysts are prepared using a starting material having the essential X-ray powder diffraction pattern of zeolite Y set forth in U.S. Pat. No. 3,130,007. A zeolitic starting material may be modified by techniques known in the art which provide a desired form of the zeolite. Thus, the use of modification techniques such as hydrothermal treatment at increased temperatures, dealumination and calcination is contemplated. A Y-type zeolite preferred for use in the present invention preferably possesses a unit cell size between about 24.20 Angstroms and 24.45 Angstroms. More preferably the zeolite unit cell size will be in the range of about 24.20 to 24.40 Angstroms and most preferably about 24.30 Angstroms. The zeolite is preferably a stabilized or ultrastable Y zeolite. The catalyst may comprise an admixture of two modified Y zeolites such as described in U.S. Pat. No. 4,661,239. The zeolite may be treated to increase its silica to alumina ratio by insertion of silica as described in U.S. Pat. Nos. 4,576,711 and 4,503,023 and in European patent application 88-361660 assigned to Akzo NV. The use of a zeolite having a silica-alumina framework ratio above 8.0 is preferred.

A zeolitic type hydrocracking composite containing no amorphous material can be produced but it is preferred that zeolitic catalysts contain between 2 wt. % and 20 wt. % of the Y-type zeolite, and more preferably between 2 wt. % and 10 wt. %. The zeolitic catalyst composition should also comprise a porous refractory inorganic oxide matrix which may form between 2 and 98 wt. and preferably between 5 and 95 wt. % of the support of the finished catalyst composite. The matrix may comprise any known refractory inorganic oxide such as alumina, magnesia, silica, titania, zirconia, silica-alumina and the like and combinations thereof which are suitable as hydrocracking catalyst components. A preferred matrix comprises silica-alumina or alumina. The most preferred matrix comprises a mixture of silica-alumina and alumina wherein said silica-alumina comprises between 5 and 45 wt. of said matrix. It is also preferred that the support comprises from about 5 wt. % to about 45 wt. % alumina.

A silica-alumina component may be produced by any of the numerous techniques which are well defined in the prior art relating thereto. Such techniques include the acid-treating of a natural clay or sand, coprecipitation or successive precipitation from hydrosols. These techniques are frequently coupled with one or more activating treatments including hot oil aging, steaming, drying, oxidizing, reducing, calcining, etc. The pore structure of the support or carrier, commonly defined in terms of surface area, pore diameter and pore volume, may be developed to specified limits by any suitable means including aging a hydrosol and/or hydrogel under controlled acidic or basic conditions at ambient or elevated temperature, or by gelling the carrier at a critical pH or by treating the carrier with various inorganic or organic reagents.

A finished catalyst for utilization in the hydrocracking zone should have a surface area of about 200 to 700 square meters per gram, a pore diameter of about 20 to about 300 Angstroms, a pore volume of about 0.10 to about 0.80 milliliters per gram, and apparent bulk density within the range of from about 0.50 to about 0.90 gram/cc. Surface areas above 350 $m^2/gm$ are greatly preferred.

An alumina component of the hydrocracking catalyst may be any of the various hydrous aluminum oxides or alumina gels such as alpha-alumina monohydrate of the boehmite structure, alpha-alumina trihydrate of the gibbsite structure, beta-alumina trihydrate of the bayerite structure, and the like. A particularly preferred alumina is referred to as Ziegler alumina and has been characterized in U.S. Pat. Nos. 3,852,190 and 4,012,313 as a by-product from a Ziegler higher alcohol synthesis reaction as described in Ziegler's U.S. Pat. No. 2,892,858. A preferred alumina is presently available from the Conoco Chemical Division of Continental Oil Company under the trademark "Catapal". The material is an extremely high purity alpha-alumina monohydrate (boehmite) which, after calcination at a high temperature, has been shown to yield a high purity gamma-alumina.

The precise physical characteristics of the catalyst such as shape and surface area are not considered to be limiting upon the utilization of the present invention. The catalyst may, for example, exist in the form of pills, pellets, granules, broken fragments, spheres, or various special shapes such as trilobal extrudates, disposed as a fixed bed within a reaction zone. Alternatively, the catalyst may be prepared in a suitable form for use in moving bed reaction zones in which the hydrocarbon charge stock and catalyst are passed either in countercurrent flow or in co-current flow. Another alternative is the use of fluidized or ebulated bed reactors in which the charge stock is passed upward through a turbulent bed of finely divided catalyst, or a suspension-type reaction zone, in which the catalyst is slurried in the charge stock and the resulting mixture is conveyed into the reaction zone. The charge stock may be passed into the reactors and in either upward or downward flow. The catalyst particles may be prepared by any known method in the art including the well-known oil drop and extrusion methods.

Although the hydrogenation components may be added to the hydrocracking catalyst before or during the forming of the support, hydrogenation components are preferably composited with the catalyst by impregnation after the selected zeolite and/or amorphous inorganic oxide materials have been formed, dried and calcined. Impregnation of the metal hydrogenation component into the particles may be carried out in any manner known in the art including evaporative, dip and vacuum impregnation techniques. In general, the dried and calcined particles are contacted with one or more solutions which contain the desired hydrogenation components in dissolved form. After a suitable contact time, the composite particles are dried and calcined to produce finished catalyst particles. Further information on the preparation of suitable hydrocracking may be obtained by reference to U.S. Pat. Nos. 4,422,959; 4,576,711; 4,661,239; 4,686,030; and, 4,695,368 which are incorporated herein by reference.

Hydrogenation components contemplated for the catalyst are those catalytically active components selected from Group VIB and Group VIII metals and their compounds. References herein to the Periodic Table are to that form of the table printed adjacent to the inside front cover of *Chemical Engineer's Handbook*, edited by R. H. Perry, 4th edition, published by McGraw-Hill, copyright 1963. Generally, the amount of hydrogenation components present in the final catalyst composition is small compared to the quantity of the other abovementioned components combined therewith. The Group VIII component generally comprises about 0.1 to about 30% by weight, preferably about 1 to about 15% by weight of the final catalytic composite calculated on an elemental basis. The Group VIB component comprises about 0.05 to about 30% by weight, preferably about 0.5 to about 15% by weight of the final catalytic composite calculated on an elemental basis. The hydrogenation components contemplated include one or more metals chosen from the group consisting of molybdenum, tungsten, chromium, iron, cobalt, nickel, platinum, palladium, iridium, osmium, rhodium, rudinium and mixtures thereof. The hydrocracking catalyst preferably contains two metals chosen from cobalt, nickel, tungsten and molybdenum.

The hydrogenation components of the catalyst will most likely be present in the oxide form after calcination in air and may be converted to the sulfide form if desired by contact at elevated temperatures with a reducing atmosphere comprising hydrogen sulfide, a mercaptan or other sulfur containing compound. When desired, a phosphorus component may also be incorporated into the hydrocracking catalyst. Usually phosphorus is present in the catalyst in the range of 1 to 30 wt. % and preferably 3 to 15 wt. % calculated as $P_2O_5$. In addition, boron may also be present in the hydrocracking catalyst.

One broad embodiment of the invention may be characterized as a process for recovering the distillate products of a hydrocracking process, which process comprises the steps of passing a liquid-phase stream comprising hydrocarbons recovered from the effluent of a hydrocracking reactor and hydrogen sulfide into a first stripping column operated at conditions effective to separate the entering liquid phase stream into a net overhead liquid stream comprising hydrogen sulfide and naphtha boiling range product hydrocarbons, a net overhead vapor stream comprising hydrogen sulfide and a first net bottoms stream comprising unconverted feed hydrocarbons and middle distillate boiling range product hydrocarbons; removing a first sidecut stream, which comprises naphtha boiling range product hydrocarbons, from the stripping column; and passing the first net bottoms stream into a middle distillate product recovery column operated at conditions effective to separate the entering hydrocarbons into a second net bottoms stream comprising unconverted hydrocarbons, a second sidecut stream, which comprises middle distillate hydrocarbons, and a second net overhead liquid stream, which comprises naphtha boiling range hydrocarbons; passing the first net overhead stream, the first sidecut stream and the second net overhead stream into a second stripping column operated to separate the entering hydrocarbons into a net overhead stream comprising propane and a third net bottoms stream which comprises naphtha boiling range hydrocarbons, and recovering naphtha boiling range hydrocarbons as a product.

The following is a list of projected operating conditions for one specific commercial scale processing unit which are presented as an aid to the practice of the invention. Line numbers correspond to the drawing. Line 4 would have a flow of 75,804 lbs/hr (34,453 kg/hr) and a temperature of 519° F. (271° C.). Line 5 would have a flow rate of 39,396 lbs/hr (17,905 kg/hr) and a temperature of 450° F. (232° C.). The stripping column overhead vapor of line 10 will have a flow rate of 34,344 lbs/hr (15,609 kg/hr), a pressure of 155 psig (1069 kPa) and a temperature of 212° F. (100° C.). The net overhead liquid of line 15 will have a flow rate of 1,837 lbs/hr (835 kg/hr) and a temperature of 120° F.(49 degrees C.). The sidecut stream of line 9 will have a flowrate of 20,627 lbs/hr (9,375 kg/hr) and a temperature of 358° F. (181° C.). The overhead liquid of line 20 will contain 2.33 lbs/hr (1.06 kg/hr) of hydrogen sulfide while the much larger sidecut stream of line 9 will contain only 1.30 lbs/hr (0.59 kg/hr) of hydrogen sulfide. The net gas withdrawn from the stripping column in line 12 will have a mass flow rate of 3,115 lbs/hr (1,416 kg/hr) and will contain 23.6 lbs/hr (10.73 kg/hr) of hydrogen sulfide.

The net bottoms stream of line 8 will have a flow rate of 144,738 lbs/hr (66,783 kg/hr). This stream is passed into distillate recovery column 27 at 493° F. (256° C.). The recovery column net overhead liquid of line 21 will have a flow rate of 12,334 lbs/hr (5,606 kg/hr). The overhead vapor of line 17 will have a temperature of 340° F. (171° C.), a pressure of 10 psig (69 kPa) and a flow rate of 74,069 lbs/hr (33,664 kg/hr). Sidecuts withdrawn from the distillate product recovery column and subsequently steam stripped will yield 19,874 lbs/hr (9,033 kg/hr) of kerosene and 9,568 lbs/hr (4,349 kg/hr) of diesel fuel.

The naphtha recovered in the subject process is preferably converted in one or more motor fuel blending components. The diesel boiling range hydrocarbon fraction is also preferably used as motor fuel. The raw fractions recovered from the process could be used directly as motor fuel but will normally be further processed to reduce sulfur content, to convert sulfur compounds to a more acceptable form, saturate aromatics, etc. The naphtha and diesel fractions may therefore be subjected to hydrotreating. The diesel fraction will normally require hydrotreating to meet environmental standards. The naphtha fraction(s) can also be treated by contacting with liquid solutions such as aqueous caustic solutions to remove hydrogen sulfide. A widely performed treating process is the Merox Process licensed by UOP wherein mercaptans are removed from the naphtha and/or converted to disulfides which may remain in the naphtha. This process is described in U.S. Pat. Nos. 4,078,992; 4,481,107 and 4,502,949 which are incorporated by reference for their teaching as to the performance of this treating step.

The total naphtha fraction produced in the subject process will normally require some further processing to meet the present commercial standards for high-quality gasoline. One widely practiced upgrading technique is catalytic reforming. In this separate process, the naphtha is contacted with a catalyst which promotes several octane number improving reactions including paraffin isomerization and the production of aromatic hydrocarbons by dehydrocyclization. Catalytic reforming is described in U.S. Pat. Nos. 3,821,104; 4,737,262; 4,703,031; 4,149,962 and 4,002,555 which are incorporated herein for their teaching as to how this process is performed and for the general content of catalytic reforming zones. Such zones normally comprise stripping columns, hydrogen recovery equipment and other product recovery facilities.

What is claimed is:

1. A process for recovering the distillate products obtained by processing feed hydrocarbons chosen from the group consisting of straight run gas oils, vacuum gas oils, demetallized oils, deasphalted vacuum residue, coker distillates, cat cracker distillates, shale oil, tar sand oil and coal liquids in a hydrocracking process, which process comprises the steps of:

a) passing a liquid-phase stream comprising both (1) hydrogen sulfide and (2) hydrocarbons, which stream has been recovered from the effluent of a hydrocracking reaction zone, into a first stripping column operated at conditions effective to separate the entering liquid phase stream into a first net overhead liquid stream comprising hydrogen sulfide and naphtha boiling range product hydrocarbons, a net overhead vapor stream comprising hydrogen sulfide and a first net bottoms stream comprising unconverted feed hydrocarbons and middle distillate boiling range product hydrocarbons boiling between 149°-371° C.;

b) removing a first sidecut stream, which comprises naphtha boiling range product hydrocarbons, from the stripping column, and;

c) passing the first net bottoms stream into a product recovery column operated at conditions effective to separate the entering hydrocarbons into a second net bottoms stream comprising unconverted feed hydrocarbons, a second sidecut stream, which comprises middle distillate hydrocarbons having boiling points between 149°-371° C., and a second net overhead liquid stream, which comprises naphtha boiling range hydrocarbons, and recovering naphtha boiling range hydrocarbons as a product.

2. The process of claim 1 wherein the first sidecut stream, the first net overhead stream and the second net overhead stream are passed into a naphtha splitting column.

3. The process of claim 1 wherein the second net bottoms stream is passed into a vacuum fractionation column and separated therein into a product stream comprising diesel boiling range hydrocarbons and a third net bottoms stream.

4. The process of claim 3 wherein at least a portion of the third net bottoms stream is recycled to the reaction zone.

5. The process of claim 1 wherein a feed stream containing less than 10 volume percent hydrocarbons having boiling points below about 240 degrees is charged to the reaction zone.

6. The process of claim 1 wherein naphtha boiling range hydrocarbons recovered from the reaction zone in the first net sidecut stream are treated for the removal of sulfur containing compounds and then blended into gasoline.

7. The process of claim 6 wherein naphtha boiling range hydrocarbons contained in the first sidecut stream are passed into a catalytic reforming zone prior to being blended into the gasoline.

8. A process for recovering the distillate products obtained by processing feed hydrocarbons having boiling points between 160° and about 443° C. in a hydrocracking process, which process comprises the steps of:

a) passing a liquid-phase stream comprising both (1) hydrogen sulfide and (2) hydrocarbons, which have both been recovered from the effluent of a hydrocracking reaction zone into a first stripping column operated at conditions effective to separate the entering liquid phase stream into a first net overhead liquid stream comprising hydrogen sulfide and naphtha boiling range product hydrocarbons, a net overhead vapor stream comprising hydrogen sulfide and a first net bottoms stream comprising unconverted feed hydrocarbons and middle distillate boiling range product hydrocarbons having boiling points between 149°-371° C.;

b) removing a first sidecut stream, which comprises naphtha boiling range product hydrocarbons, from the first stripping column, and;

c) passing the first net bottoms stream into a product recovery column operated at conditions effective to separate the entering hydrocarbons into a second net bottoms stream comprising unconverted feed hydrocarbons, a second sidecut stream, which comprises middle distillate hydrocarbons having boiling points between 149°-371° C., and a second net overhead liquid stream, which comprises naphtha boiling range hydrocarbons;

d) passing the first net overhead stream, the first sidecut stream and the second net overhead stream into a second stripping column operated to separate the entering hydrocarbons into a net overhead stream comprising propane and a third net bottoms stream which comprises naphtha boiling range hydrocarbons, and recovering naphtha boiling range hydrocarbons as a product.

9. The process of claim 8 wherein the second net bottoms stream is passed into a vacuum fractionation column and separated therein into a product stream comprising diesel boiling range hydrocarbons and a third net bottoms stream.

10. The process of claim 9 wherein at least a portion of the third net bottoms stream is recycled to the reaction zone.

11. The process of claim 10 wherein a feed stream charged to the reaction zone contains less than 10 volume percent hydrocarbons boiling points below about 240 degrees C.

12. The process of claim 8 wherein naphtha boiling range hydrocarbons recovered from the reaction zone in the first net sidecut stream are treated for the removal of sulfur containing compounds and then blended into a gasoline.

13. The process of claim 8 wherein naphtha boiling range hydrocarbons contained in the first sidecut stream are passed into a catalytic reforming zone prior to being blended into the gasoline.

14. The process of claim 13 wherein diesel boiling range hydrocarbons are removed from the middle distillate product recovery column as a sidecut stream and withdrawn from the process as a product.

15. The process of claim 8 wherein the liquid-phase stream comprising hydrocarbons recovered from the effluent of the reaction zone is removed from a hot flash separation zone located in the reaction zone.

* * * * *